US006926290B2

(12) United States Patent
Tang

(10) Patent No.: US 6,926,290 B2
(45) Date of Patent: Aug. 9, 2005

(54) MAGNETICALLY-RESTORED STEERABLE ROLLER SKATE

(76) Inventor: Kuo-Tai Tang, No. 2, Alley 33, Lane 31, Ho-Ping Rd., Pin Chen, Taoyuan (TW)

( * ) Notice: Subject to any disclaimer, the term of this patent is extended or adjusted under 35 U.S.C. 154(b) by 130 days.

(21) Appl. No.: 10/307,707

(22) Filed: Nov. 29, 2002

(65) Prior Publication Data

US 2004/0104548 A1 Jun. 3, 2004

(51) Int. Cl.[7] ..... A63C 1/00

(52) U.S. Cl. ..... 280/11.27; 280/11.28; 280/11.19

(58) Field of Search ..... 280/11.27, 11.28, 280/11.19, 81.6, 776, 268, 271, 809, 816, 87.042, 84; 16/320

(56) References Cited

U.S. PATENT DOCUMENTS 4,434,524 A * 3/1984 Gilchrist ..... 16/250
4,505,502 A * 3/1985 Tomita ..... 292/251.5
5,183,277 A * 2/1993 Tang ..... 280/11.28
5,441,287 A * 8/1995 Tang ..... 280/11.28
5,711,539 A * 1/1998 Tang ..... 280/11.27
5,967,530 A * 10/1999 Chung ..... 280/11.19
6,439,584 B1 * 8/2002 Lai ..... 280/11.27

* cited by examiner

*Primary Examiner*—Christopher P. Ellis
*Assistant Examiner*—Brian Swenson

(57) ABSTRACT

A steerable roller skate includes: a sole member of a skate boot or fastening strap of roller skate having a pair of rear wheels transversely rotatably secured to a rear bottom portion of the sole member, a steering base steerably secured on a front bottom portion of the sole member, a pair of front wheels transversely rotatably secured on the steering base, a first circular magnet secured on a central bottom portion of the sole member, and a second circular magnet secured on the steering base adjacent to the first circular magnet having opposite magnetic polarities of the first and second circular magnets for normally attracting the second magnet to the first magnet with a greater magnetic attractive force between the first and second magnets for efficiently magnetically restoring the steering base and the front wheels for automatically resetting a straightforward orientation of the roller skate.

2 Claims, 3 Drawing Sheets

MAGNETICALLY-RESTORED STEERABLE ROLLER SKATE

BACKGROUND OF THE INVENTION

U.S. Pat. No. 5,711,539 issued to the same inventor disclosed a magnetically-restored steerable roller skate. However, it has the following drawbacks:

1. Once the magnet 4*b* is damaged, it is difficult to dismantle the magnet from its holder (25*f*).
2. The aperture A between the first and second magnets 4*a*, 4*b* is fixed and not adjustable. For a big aperture as caused by poor quality control during the manufacturing, a magnetic attractive force between the two magnets will be weakened.
3. The magnet is formed as a slim rectangular shape, producing smaller magnetic force.

The present inventor has found the drawbacks of the prior art and invented the present roller skate with enhanced functions.

SUMMARY OF THE INVENTION

The object of the present invention is to provide a steerable roller skate including: a sole member of a skate boot or fastening strap of roller skate having a pair of rear wheels transversely rotatably secured to a rear bottom portion of the sole member, a steering base steerably secured on a front bottom portion of the sole member, a pair of front wheels transversely rotatably secured on the steering base, a first circular magnet secured on a central bottom portion of the sole member, and a second circular magnet secured on the steering base adjacent to the first magnet having opposite magnetic polarities of the first and second magnets for normally attracting the second magnet to the first magnet with a greater magnetic attractive force between the first and second magnets for efficiently magnetically restoring the steering base and the front wheels for automatically resetting a straightforward orientation of the roller skate.

DETAILED DESCRIPTION

Figure 1:
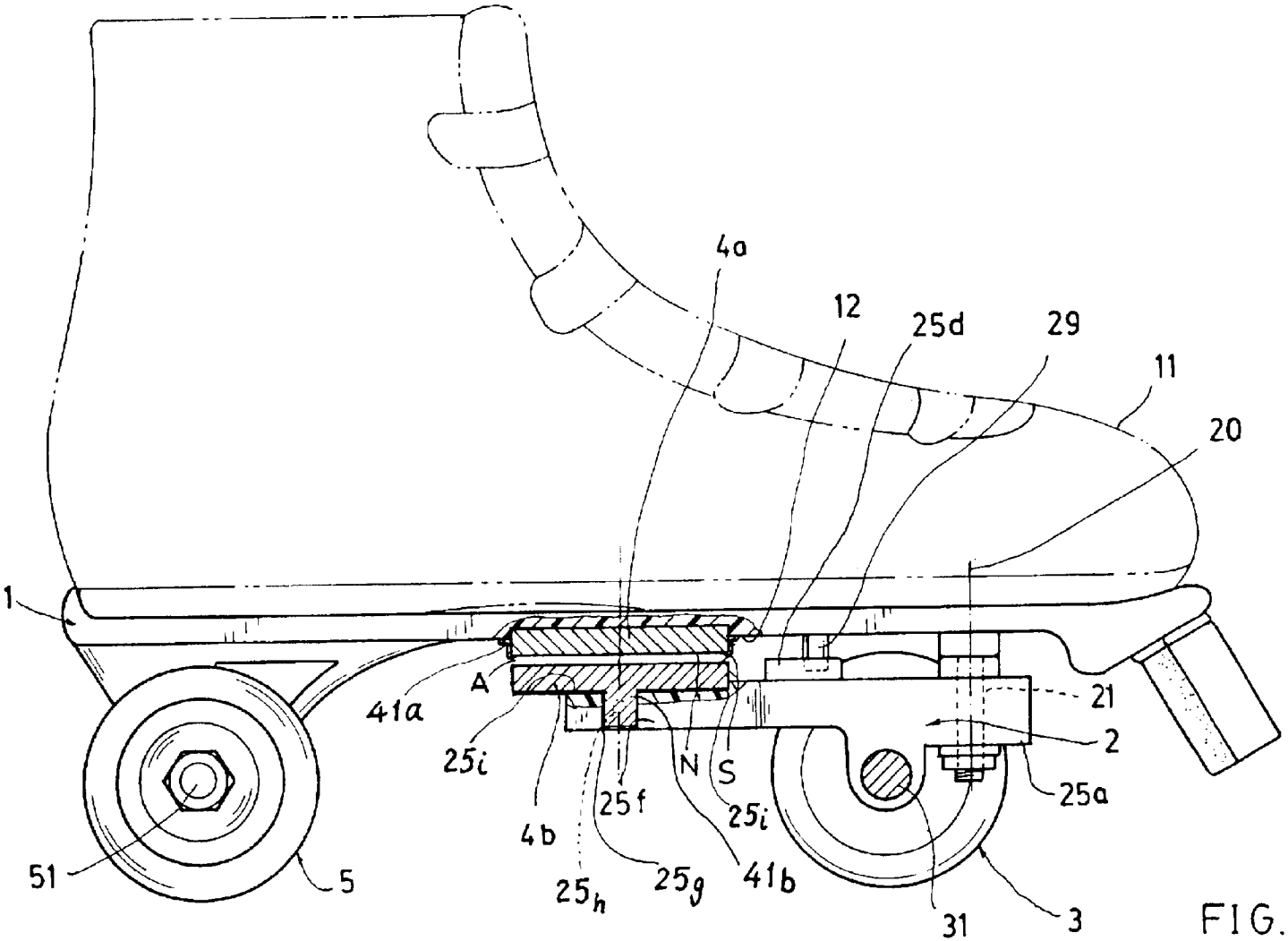
FIG. 1 is an illustration showing a roller skate of the present invention.
Figure 2:
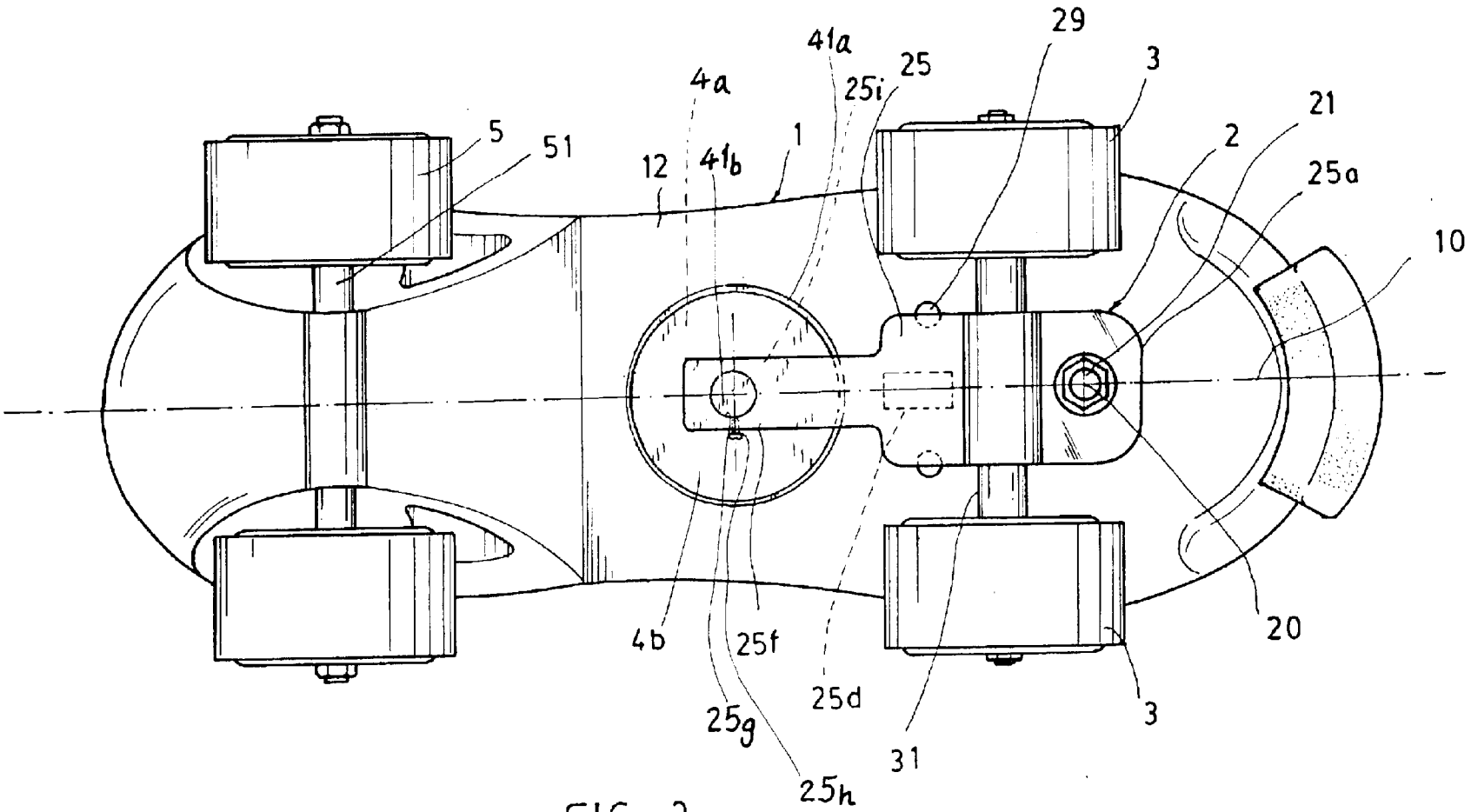
FIG. 2 is a bottom view of the present invention.
Figures 3, 4:
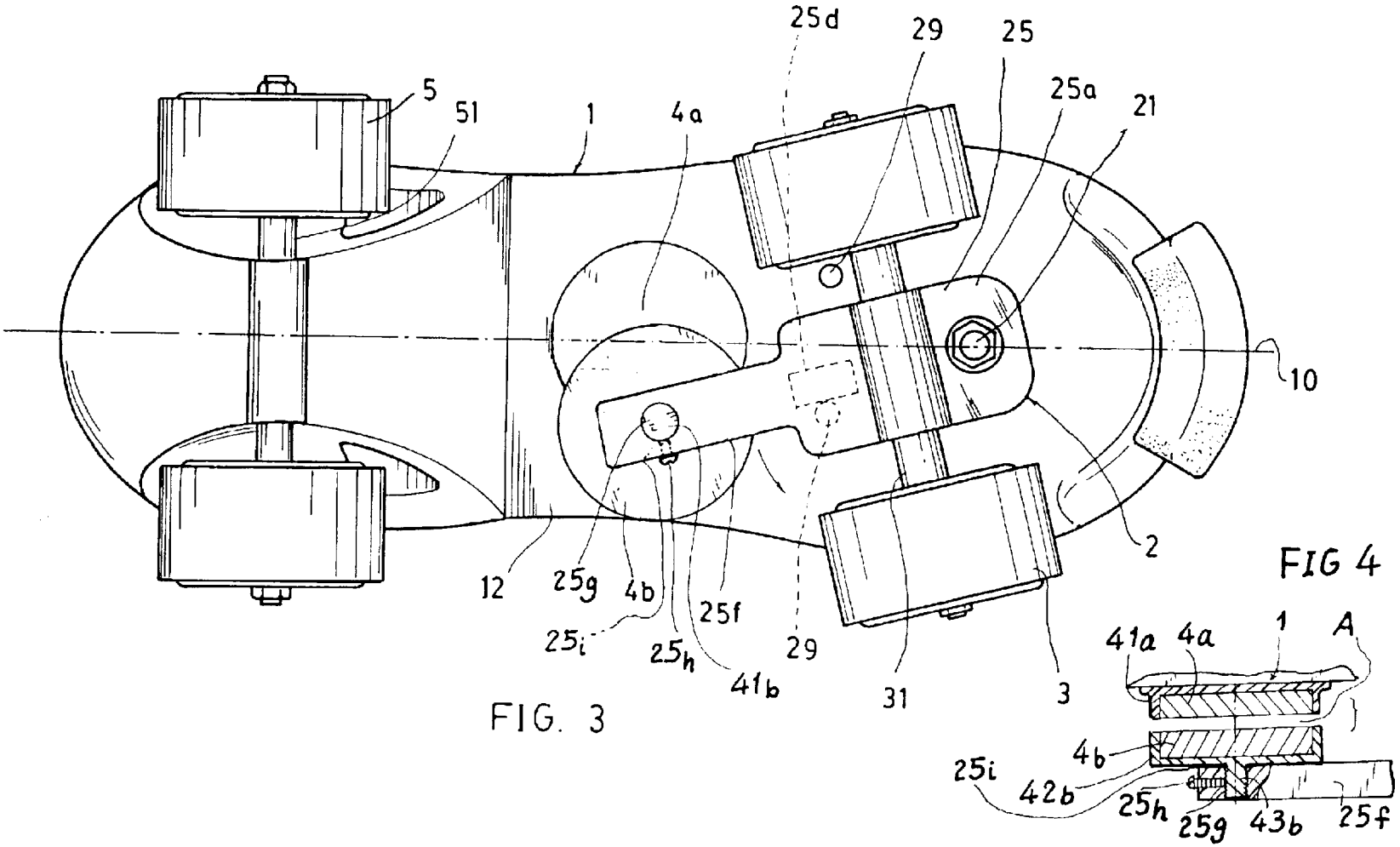
FIG. 3 is a bottom-view illustration showing a roller skate as sidewardly biased.
FIG. 4 is a partial sectional drawing showing a retaining cup provided for securing the second magnet of the present invention.

As shown in FIGS. 1~3, a preferred embodiment of the roller skate of the present invention comprises: a sole member 1 of a skate boot or fastening strap 11 of a roller skate defining a longitudinal axis 10 at a longitudinal center of the sole member 1, a steering means 2 steerably secured to a front bottom portion of the sole member 1, a pair of front wheels 3 rotatably transversely secured on the steering means 2 by a front axle 31, a pair of rear wheels 5 rotatably transversely secured to a rear bottom portion of the sole member 1, a first magnet 4*a* secured on a central bottom portion 12 of the sole member 1, and a second magnet 4*b* secured on the steering means 2. The pair of rear wheels 5 are rotatably secured on a rear axle 51, generally perpendicular to the longitudinal axis 10 of the sole member 1.

The steering means 2 includes: a steering base 25 having a front base portion 25*a* drilled with a vertical bolt hole for rotatably engaging a front bolt 21 vertically secured in a front bottom portion of the sole member 1 about a front vertical axis 20, an axle hole horizontally transversely formed through a middle portion of the steering base 25 for rotatably engaging a front axle 31 for rotatably securing the pair of front wheels 3 on the steering base 25, and a rear extension portion 25*f* formed on a rear portion of the steering base 25. The vertical axis 20 of the bolt 21 is projectively perpendicular to the longitudinal axis 10 of the sole member 1.

The first magnet 4*a* is secured in a retaining sleeve 41*a* which is then fixed to the central bottom portion 12 of the sole member 1 having a magnetic polarity of the first magnet 4*a* opposite to a magnetic polarity of the second magnet 4*b* secured on the rear extension portion 25*f* of the steering base 25 for a mutual magnetic attraction between the first and second magnets 4*a*, 4*b*.

Either the first magnet 4*a* or the second magnet 4*b* is formed as a circular shape as shown in FIGS. 2, 3 to increase their magnetic attraction force since the circular magnet 4*a*, 4*b* has a volume or area larger than the slim rectangular-shaped magnet as disclosed in U.S. Pat. No. 5,711,539.

The second magnet 4*b* formed as circular shape includes: a stem 41*b* protruding downwardly to be engaged with a stem hole 25*g* vertically formed in the rear extension portion 25*f* protruding rearwardly from the steering base 25, an adjusting screw 25*h* rotatably mounted in the rear extension portion 25*f* for fastening the stem 41*b* of the second magnet 4*b*, and at least a packing washer 25*i* packed between the second magnet 4*b* and the rear extension portion 25*f* to adjust a distance of an aperture A as spaced between the first and second magnets 4*a*, 4*b*, whereby upon disengagement of the screw 25*h* from the stem 41*b* of the second magnet 4*b*, the second magnet 4*b* may be detached from the extension portion 25*f* for maintenance or the position of the second magnet 4*b* on the extension portion 25*f* may be varied to adjust the aperture A between the first and second magnets 4*a*, 4*b* as packed by the packing washer 25*i* which may be selected by a plurality of layers of washers 25*i* or by varying the thickness of the washer 25*i*.

Accordingly, the present invention is superior to the prior art, i.e., U.S. Pat. No. 5,711,539 with the following advantages:

1. The circular-shaped magnet 4*a*, or 4*b* has a greater magnetic attraction force than the slim rectangular-shaped magnets of the prior art.
2. The aperture A may be adjusted to overcome the improper aperture due to poor quality control during the manufacturing. Otherwise, a small aperture between the magnets may cause a frictional contacting between the two magnets 4*a*, 4*b*; while a large aperture may decrease the magnetic attraction force therebetween.
3. Once the magnet 4*b* is damaged, the screw 25*h* may be loosened for replacing a new magnet 4*b*.

So, the present invention is superior to U.S. Pat. No. 5,711,539.

Naturally, the first magnet 4*a* may be attracted to a ferrous plate (which is not numbered and is provided to substitute the second magnet 4*b*) secured to the bottom 12 of the sole member 1 for a mutual magnetic attraction between the first magnet 4*a* and the ferrous plate.

The bottom portion 12 of the sole member 1 and the steering base 25 may be made of non-ferrous materials for preventing loss of magnetic property of the magnets 4*a*, 4*b*.

The steering base 25 further includes a limiting projection 25*d* protruding upwardly from a central portion of the steering base 25 to be retarded by a pair of stoppers 29 respectively disposed on opposite side portions on a front bottom portion of the sole member 1 to prevent falling off of a skate player when rightwardly or leftwardly steering a roller skate of the present invention.

The first magnet 4*a*, when magnetically restored, has a center aligned with the longitudinal axis 10 of the sole member 1. The second magnet 4*b* secured on the steering base 25 is positioned corresponding to and adjacent to the first magnet 4*a* to define the aperture A between the first and second magnets 4*a*, 4*b*.

The circular shape of the magnet 4*a* or 4*b* may also be modified to be a hexagonal or octagonal shape.

The fixing or joining methods for securing the two magnets on the skate may be further modified and not limited in this invention.

Upon a skating by a player, the front wheels 3 may be biased sidewardly as shown in FIG. 3 to forcibly move the second magnet 4*b* from the first magnet 4*a* for deviating the skating direction from a straightforward direction aligned with the longitudinal axis 10 to a sideward orientation as shown in the arrow direction in FIG. 3.

Then, the player lifts his foot for a next skating step, the magnetic attraction between the two magnets 4*a*, 4*b* will automatically restore the steering base 25 to allow the front axis 31 to be perpendicular to the longitudinal axis 10 of the sole member for resetting a straightforward direction, ready for next biasing movement either rightwardly or leftwardly.

Therefore, the present invention may automatically restore or reset the front wheels for an initial straightforward skating orientation for enhancing safety and maneuverability.

And the circular-shaped magnets 4*a*, 4*b* may increase their magnetic attraction force. The mechanism for mounting the second magnet 4*b* as aforementioned may render the roller skate to be easily maintained or adjusted than the prior art.

The present invention may, for instance, be modified without departing from the spirit and scope of the invention.

The present invention may be further modified to be shown in FIG. 4, in which a circular second magnet 4*b* is fixed in a retaining cup 42*b* having a male-threaded stem 43*b* formed on a bottom portion of the retaining cup 42*b* to be engaged with a female-threaded hole 25*g* formed in the rear extension portion 25*f* of the steering base 25 and having a screw 25*h* rotatably mounted in the rear extension portion 25*f* for fastening the stem 43*b* of the second magnet 4*b* on the rear extension portion 25*f*. A washer 25*i* is provided in between the second magnet 4*b* (on the cup 42*b*) and the rear extension portion 25*f*.

The stem 41*b* or 43*b* on the bottom of the second magnet 4*b* may also be eliminated from the circular magnet 4*b* for a simpler modification of the present invention.

I claim:

1. A steerable roller skate comprising:

a sole member having a longitudinal axis defined at a central portion thereof and having a pair of rear wheels transversely rotatably secured to a rear bottom portion of said sole member, a steering means having a steering base steerably secured to a front bottom portion of said sole member, a pair of front wheels transversely rotatably secured to the steering base of said steering means by a front axle, a first magnet secured to a central bottom portion of said sole member, and a second magnet secured on said steering base normally positioned under said first magnet, said first and second magnets having opposite magnetic polarities thereof for a mutual magnetic attraction between said first and second magnets for normally restoring the steering base and the front wheels to allow said front axle to be projectively perpendicular to said longitudinal axis of said sole member for a normal straightforward skating of said roller skate; the improvement which comprises:

said first magnet and said second magnet respectively formed as circular shape, and said second magnet including: a stem protruding downwardly to be engaged with a stem hole vertically formed in a rear extension portion protruding rearwardly from the steering base, an adjusting screw rotatably mounted in the rear extension portion for fastening the stem of the second magnet on the rear extension portion, and at least a packing washer packed between the second magnet and the rear extension portion to adjust a distance of an aperture as spaced between the first and second magnets, whereby upon disengagement of the screw from the stem of the second magnet, the second magnet will be detached from the rear extension portion for the maintenance thereof, and the position of the second magnet on the rear extension portion may be varied to adjust the aperture between the first and second magnets.

2. A steerable roller skate comprising:

a sole member having a longitudinal axis defined at a central portion thereof and having a pair of rear wheels transversely rotatably secured to a rear bottom portion of said sole member, a steering means having a steering base steerably secured to a front bottom portion of said sole member, a pair of front wheels transversely rotatably secured to the steering base of said steering means by a front axle, a first magnet secured to a central bottom portion of said sole member, and a second magnet secured on said steering base normally positioned under said first magnet, said first and second magnets having opposite magnetic polarities thereof for a mutual magnetic attraction between said first and second magnets for normally restoring the steering base and the front wheels to allow said front axle to be projectively perpendicular to said longitudinal axis of said sole member for a normal straightforward skating of said roller skate; the improvement which comprises:

said first magnet and said second magnet respectively formed as a circular shape, and said second magnet fixed in a retaining cup having a male-threaded stem formed on a bottom portion of the retaining cup to be engaged with a female-threaded hole formed in a rear extension portion protruding rearwardly from the steering base and having a screw rotatably mounted in the rear extension portion for fastening the stem, formed on a bottom of the second magnet, to the rear extension portion of the steering base.

* * * * *